United States Patent [19]

Shemitz et al.

[11] 4,006,355

[45] Feb. 1, 1977

[54] LUMINAIRE

[75] Inventors: Sylvan R. Shemitz, Woodbridge; Benjamin L. Stahlheber, Clinton, both of Conn.

[73] Assignee: Sylvan R. Shemitz and Associates, Inc., New Haven, Conn.

[22] Filed: Dec. 26, 1974

[21] Appl. No.: 536,588

[52] U.S. Cl. ..... 240/51.11 R; 240/78 LK; 240/103 R

[51] Int. Cl.[2] ..... H05B 33/02

[58] Field of Search ..... 240/78 LK, 78 LD, 51.11, 240/103 R, 103 B, 109, 41.35 R, 46.01, 46.45, 46.47

[56] References Cited

UNITED STATES PATENTS

| | | | |
|---|---|---|---|
| 2,232,499 | 2/1941 | Waterbury | 240/78 LD |
| 3,246,138 | 4/1966 | Florence | 240/51.11 R |
| 3,413,460 | 11/1968 | Sjolander | 240/78 LK |
| 3,829,677 | 8/1974 | Dellano | 240/51.11 R |

FOREIGN PATENTS OR APPLICATIONS

| | | | |
|---|---|---|---|
| 505,897 | 10/1938 | United Kingdom | 240/103 B |

*Primary Examiner*—L. T. Hix
*Assistant Examiner*—J. A. LaBarre
*Attorney, Agent, or Firm*—DeLio and Montgomery

[57] ABSTRACT

A luminaire having a pair of parabolic reflectors or a reflector having a continuous parabolic surface of revolution, a light source within the parabolic surface or surfaces having a light emitting envelope, and a plurality of light absorbing surfaces positioned to cut off substantially all light emanating from the light source envelope which would otherwise have been reflected or directed into the zone of about 45° to about 90° above nadir. The parabolic reflectors or surface are arranged to provide maximum candlepower in the zone of about 25° to 45° above nadir. The luminaire eliminates direct discomfort glare and substantially eliminates veiling reflections in seeing tasks located on the working plane. The luminaire is adapted for surface, pendant or recessed ceiling mounting or for mounting above the task area from floor or table mounted supports, or inverted to illuminate the ceiling.

6 Claims, 7 Drawing Figures

24
28
29
33
12
21
22
23
35
25
25
36
32
32
35
35
34
34
34
36
34
31

41
42
43
37
39
38
44
44
45

LUMINAIRE

BACKGROUND OF THE INVENTION

This invention relates primarily to luminaires for ceiling mounting, whether on the ceiling surface, suspended therefrom or recessed therein. It also relates to units emitting luminous flux upward for the purpose of reflecting light off a surface above.

For optimum lighting efficiency and architecturally pleasing appearance, lighting fixtures mounted in or on the ceiling have most often been utilized, especially when the area to be lighted is large. Such areas include open spaces in business offices, department stores, grocery stores, classrooms, warehouses, corridors, and the like. While luminaires incorporating one or more parabolic reflecting surfaces have been used to reflect or redirect light in order to provide efficient distribution of light flux, photometrically illustrated as half bat-wing or full bat-wing shaped areas defined by photometric curves showing relative candlepower distribution, their efficiency has not been fully utilized due to veiling reflections and direct discomfort glare especially resulting when the light source includes a light diffusing envelope enclosing a light emitter (i.e., phosphor coated lamps such as, but not limited to, mercury, fluorescent or metal halide.)

Veiling reflections are the reflections of a light source in the visual task, (e.g., the printed page) that cause a reduction in luminance contrast (e.g., between the print and its background). Since the normal sightline of a worker, in performing a desk-type visual task, is downward in a line about 25° to the worker's side of a line perpendicular to the plane of the task, a light source which is positioned approximately in a line 25° behind the line perpendicular to the plane of the task, will be reflected by the task into the eyes of the worker. The black part of a visual task (such as print) approaches the brightness of the white part (such as paper) and thus a reduction of luminance contrast results, reducing visibility. The reflections therefore act as a veil placed on the visual task, hence, the term, veiling reflections.

The deficiency results especially from improper distribution of light flux in the work surface zone, that is, the zone of about 0° to about 25° above nadir. This zone is the normal sitting viewing zone of an office worker at his desk. Even through exsisting ceiling fixtures utilize one or more parabolic reflectors for more efficient candlepower distribution and minimization of veiling reflections, some veiling reflections nevertheless are apparent from a task in the 0° – 25° zone when the light source has a light diffusing envelope.

Study of the problem has revealed that the veiling reflections and direct glare (at normal viewing angles 45° – 90° from nadir) result from either improper placement of the parabolic reflectors or surface relative to the light source, or the light source having light diffusing envelopes which provide light emanations from near tangential on all surfaces of the light diffusing envelope of the light source. Accordingly, a significant improvement in the utilization of parabolic reflectors in ceiling lighting fixtures will result if the parabolic reflectors can be arranged, and other means provided, to eliminate the effects of the nearly tangential light emanations in the zone of about 45° to 90° and 0° to about 25° above nadir.

Comparable considerations apply to the mounting of a luminaire inverted to illuminate the ceiling from a position below standing eye level or from a higher position (when desired) in order that the brightness of the ceiling directly over the luminaire, which might otherwise be excessive, may be ameliorated by the control inherent in this new design. (References herein to "above nadir" should be read as "below zenith" when referring to the luminaire in inverted position.

OBJECTS AND SUMMARY

An object of the invention therefore is to provide a new and improved luminaire which is architecturally pleasing and which provides controlled illumination of work areas with minimum direct discomfort glare.

Another object of the invention is to provide a new and improved luminaire for mounting on, in or below the ceiling whereby veiling reflections in the zone of about 0° to about 25° above nadir are substantially eliminated.

Still another object of the invention is to provide a new and improved luminaire utilizing a light source having a light diffusing envelope such as a phosphor coated mercury lamp, a metal halide coated lamp, a fluorescent lamp or a frosted incandescent lamp so as to provide maximum candlepower distribution in the 25° to about 45° zone above nadir, but with minimum veiling reflections.

A further object of the invention is to provide a new and improved luminaire adapted to be mounted in a position to direct luminous flux upward, with controlled distribution.

A still further object of the invention is to provide certain improvements in the form, construction, arrangement and materials of the luminaire whereby the above named and other objects may effectively be attained.

These and other objets, features and advantages of the invention will be apparent from the specification which follows.

In brief outline, the objects of the invention are achieved by utilizing at least one pair of parabolic reflectors or a single reflector that is a parabolic surface of revolution positioned in specific orientations about a light source having a light diffusing envelope, in combination with a plurality of light absorbing surfaces also positioned at specific orientations relative to the light source, light envelope and parabolic reflectors. The parablic reflectors or reflector are oriented with respect to the light source so that their focal points substantially coincide, and the light emitter within the light diffusing envelope is positioned at such coincident foci. The reflectors also are positioned such that reflections therefrom provide maximum candlepower in the zones of about 25° to about 45° above nadir, thereby to form the familiar full bat-wing configuration when the light flux of the luminaire is analyzed and plotted photometrically. Veiling reflections are thereby substantially eliminated in the important work zone. The light absorbing surfaces are positioned between the reflectors so as to absorb substantially all light emanating nearly tangentially from the light source envelope into the reflectors that would reflect into the 45° to about 90° above nadir zone, thereby minimizing the direct discomfort glare which otherwise would result.

The invention accordingly comprises the features of construction, combination of elements, and arrangement of parts which will be exemplified in the constructions hereinafter set forth, and the scope of the invention will be indicated in the claims.

DETAILED DESCRIPTION

For a fuller understanding of the nature and objects of the invention, reference is had to the following description taken in conjunction with the accompanying drawings, in which.

Figure 1:
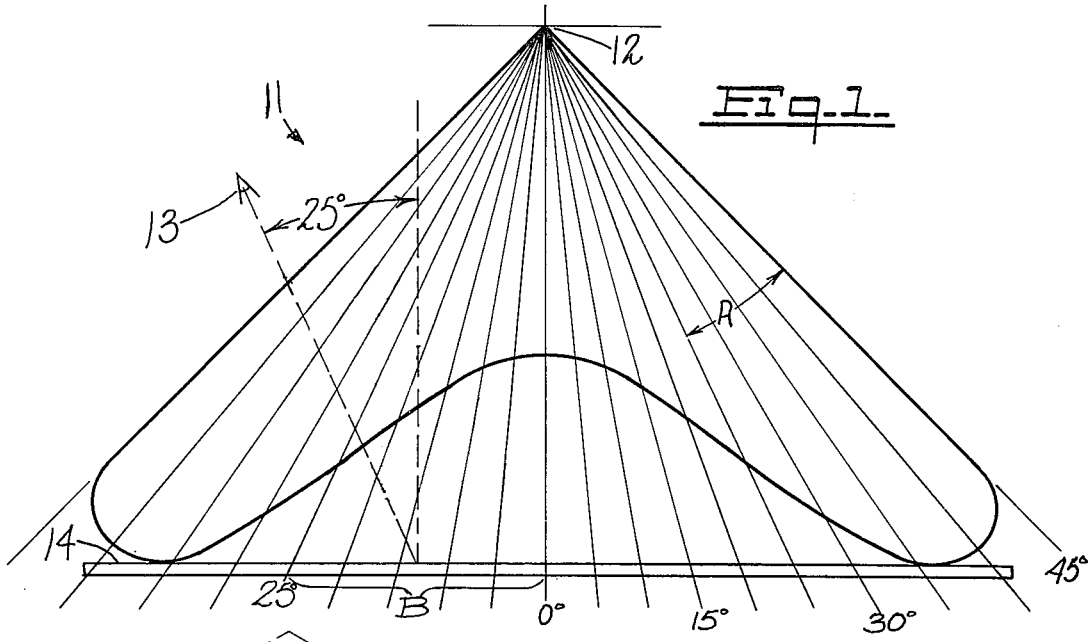
FIG. 1 is an approximate photometric curve showing relative candlepower in a vertical plane through light flux from a luminaire of the invention.

With reference to FIG. 1, the area under the photometric (relative candlepower) curve 11 by virtue of its full bat-swing configuration indicates that luminaries of the invention provide near ideal light flux distribution from a ceiling mounted light source 12. Maximum candle-power is shown to be in the zone of about 25° to about 45° above nadir, both to right and left of nadir, subtending the angle A. Preferably, the maximum candlepower is within the 35° – 45° zones, with cut-off of emanations and reflections at 45°. In addition, it is a frequent occurrence that a person is so positioned that the light source 12 is in front of and above his eyes shown diagrammatically at 13. This diagram defines a zone B of about 0° to about 25° from nadir which includes in most desk-type applications the area of the task on a horizontal surface 14. The luminaire of the invention thus distributes light emanations with maximum efficiency throughout the entire area to be lighted (work surface as well as background); as will become evident from the discussion following, luminaires of the invention substantially reduce veiling reflections in the work zone.

Figure 2:
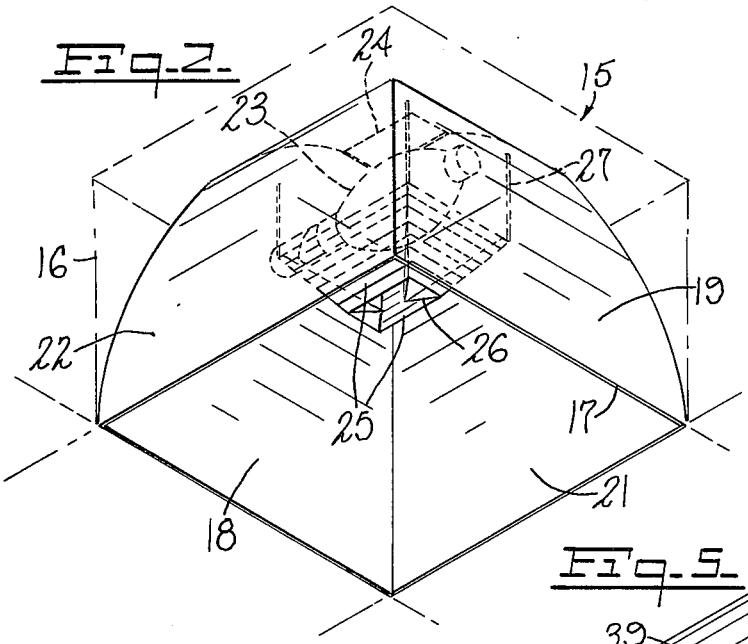
FIG. 2 is a partially diagrammatic, perspective view from below one embodiment of a luminaire of the invention.
Figure 3:
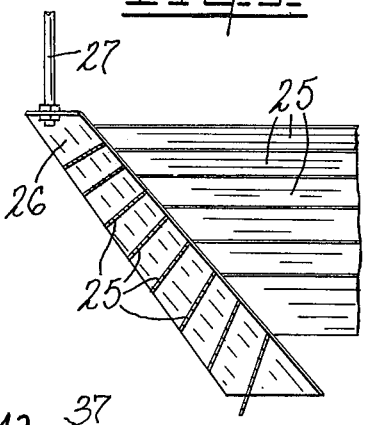
FIG. 3 is a detailed, sectional and side elevational view of a portion of the luminaire shown in FIG. 2.

In the underside view of a luminaire 15 of the invention, illustrated in FIG. 2, the luminaire can include a housing or frame 16 wherein the lower edge 17 of the frame can coincide with the plane of a ceiling. The luminaire is thus recessed, this being a frequently desired arrangement from an architectural standpoint. Surface mounting of the luminaire on the ceiling or pendant mounting can also be effected, if desired. Within the housing 16 is at least one pair of opposing parabolic reflectors 18 and 19 and preferably a second pair of opposing parabolic reflectors 21 and 22 mounted adjacent the first pair of reflectors so as to form a shell about a light source 23. An opening 24 serving as an air vent may be positioned above the reflectors, if the light source is of a type generating considerable heat. It might also serve to allow light to be emanated upward if mounted as shown, or downward if the unit is inverted.

Positioned between the parabolic reflectors (or the parabolic surface, as the case may be) and below the light source 23 is a plurality of light absorbing surfaces 25. The light absorbing surfaces 25 are shown as elongated planes held together by struts 26 and suspended from upper portions of the parabolic reflectors by rods 27. However, the absorbers may have other geometrical configurations. The absorbers are formed of any suitable light-absorbing medium, such as matte black paint on metal surfaces or the like. A significant spatial relationship is maintained between the parabolic reflectors, the light absorbing surfaces and the light source 23. This relationship is best understood by consideration of FIG. 4.

Figure 4:
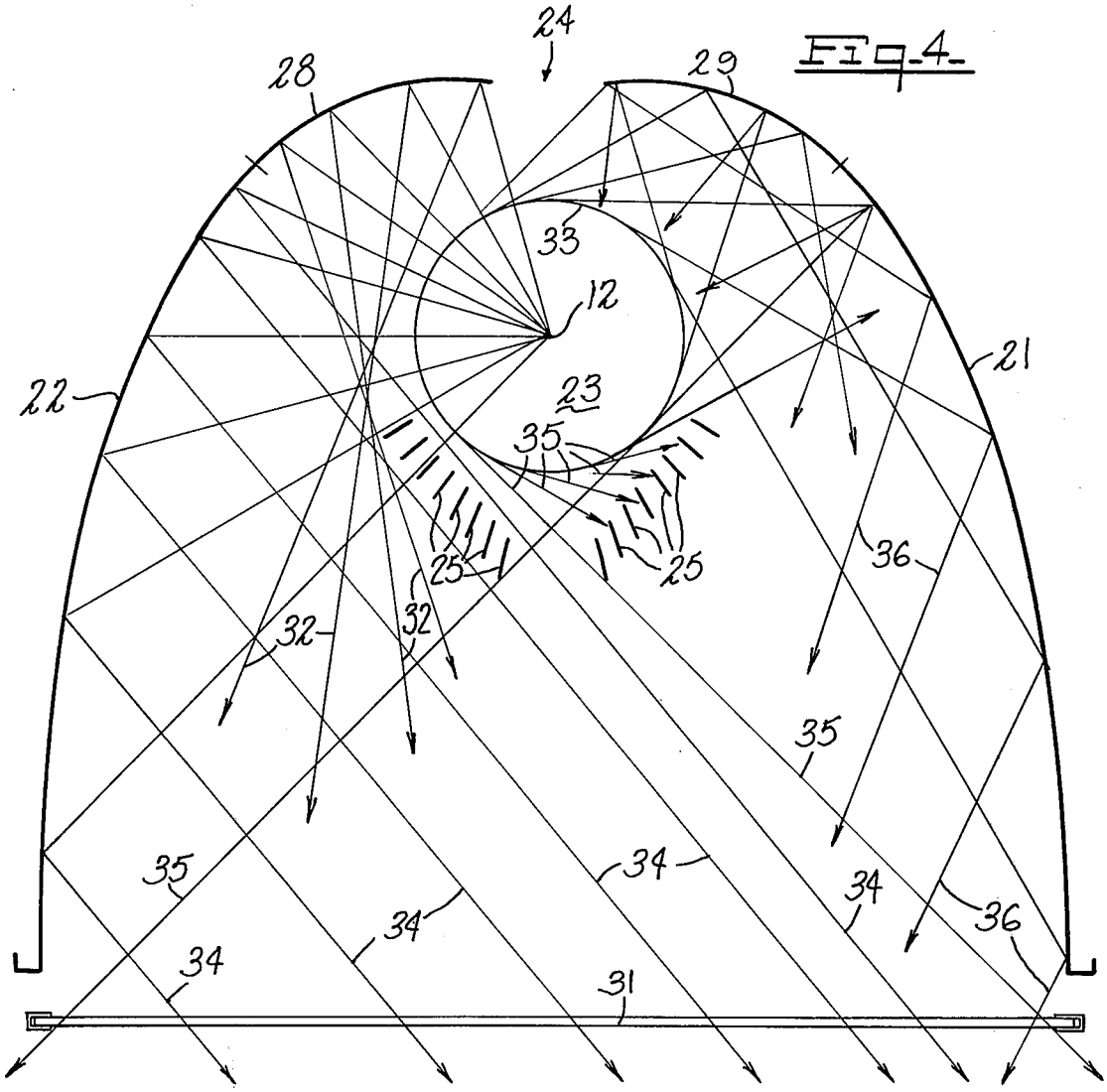
FIG. 4 is a diagrammatic view of the emanations and reflections of the luminaire of FIG. 2.

With reference to FIG. 4, the light source 23 is shown in end view and is positioned between the parabolic reflectors shown in section, such as reflectors 21 and 22. The parabolic reflectors (or the parabolic surface of revolution reflector) 21 and 22 are positioned such that thier foci substantially coincide, the coincident foci also being coincident with the center of the light source 12. However, the axes of the parabolic reflectors are set such that the reflections therefrom cross and provide maximum candlepower distribution in the zone of about 25° to about 45° above nadir, preferably 35° to 45°, and on both sides of nadir so as to define the familiar full batwing photometric curve.

While the total reflecting surface may be parabolic, it is preferred to insert general reflecting surfaces 28 and 29 in place of the upper portions of the parabolic reflectors so that the light emanations higher than about 135° above nadir will be reflected downwardly as shown by reflections 32, rather than back into the light source.

It will thus be noted that the emanations and reflections from the light source 23 are of several varieties. The first is the parallel reflections 34 from each of the parabolic reflectors 21 and 22, which cross over and are directed to provide the full bat-wing candlepower distribution photometrically illustrated in FIG. 1. The second variety is the downward reflections 32 from the general reflecting surfaces 28 and 29. The third variety comprises the light rays 35 which emanate directly and near tangentially from the light diffusing envelope 33. The tangential emanations from the top half of the lamp are reflected as rays 36 and therefore cause no direct glare from a normal viewing angle.

The light absorbing surfaces 25 are positioned to provide effective cut-off of tangential light emanations in the zone between about 45° and 120° above nadir. If such light emanations had been allowed to reach the reflector, they would have reflected out of the luminaire in the zone of 45° above nadir to 90° above nadir, thereby causing direct discomfort glare. Preferably the absorbing surfaces 25 are planar and are set at angles other than tangential to the light diffusing envelope 33, such as angles radial to the center of the light source or emitter 12. The light absorbing surfaces 25 may extend around the entire lower half of the envelope 33 or they may be separated into several, spaced-apart sets, as shown.

The light source 23 and its light diffusing envelope 33 may have any suitable geometric form, although generally the form will be spherical, globular or tubular, for example. Among suitable lamps may be mentioned phosphor-coated mercury, coated metal halide, fluorescent, and frosted incandescent.

Figure 5:
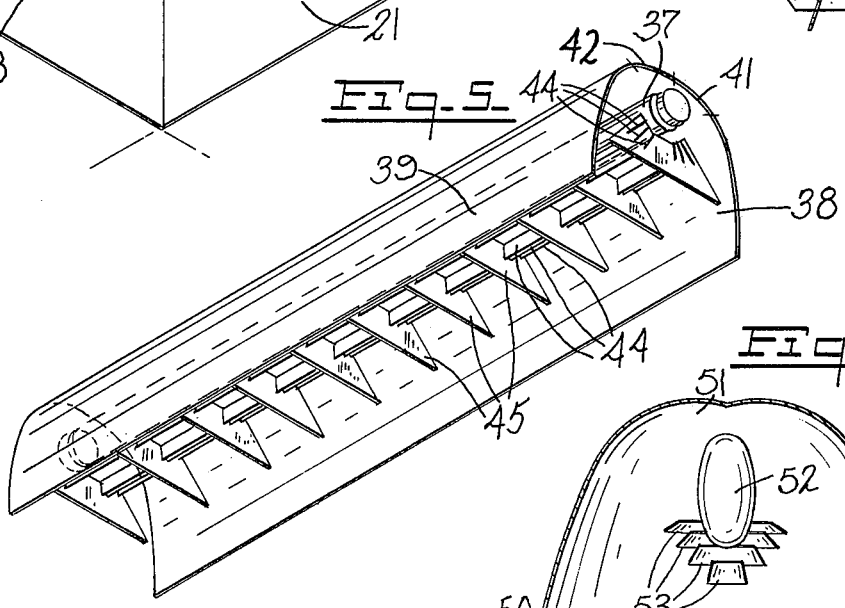
FIG. 5 is a perspective view of another embodiment of luminaire of the invention.
Figure 6:
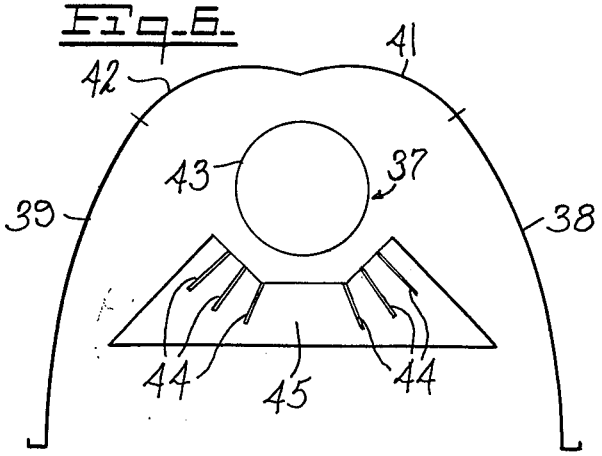
FIG. 6 is an end view of the luminaire of FIG. 5.

In another embodiment of the invention, with reference to FIGS. 5 and 6, the light source may be an elongated tube such as the fluorescent tube 37. A single pair of longitudinally elongated parabolic reflectors 38 and 39 generally will be sufficient in this embodiment, preferably in combination with a pair of general reflectors 41 and 42 corresponding in position to reflectors 28 and 29 of FIGS. 2 and 4. The reflecting surfaces are positioned relative to the fluorescent tube 37 and its envelope 43 substantially as described with respect to the first embodiment of the invention, as illustrated in FIGS. 1–4. A plurality of light absorbing surfaces 44 extend longitudinally of the tube 37 and are positioned for cut-off of tangential light emanations from envelope 43 that would otherwise have reflected into the 45° to 90° zone above nadir, substantially as described with respect to the embodiment of FIGS. 1–4.

However, since the elongated nature of tube 37 would cause light emanating at high angles to result in direct glare into the eyes of a viewer, a plurality of light absorbers 45 are mounted transversely of the absorbers 44 so that the tube 37 cannot be viewed directly from either end thereof at normal viewing angles. Accordingly, the luminaire of FIGS. 5 and 6 also provides illumination producing minimum veiling reflections and direct glare from substantially any normal viewing angle.

Figure 7:
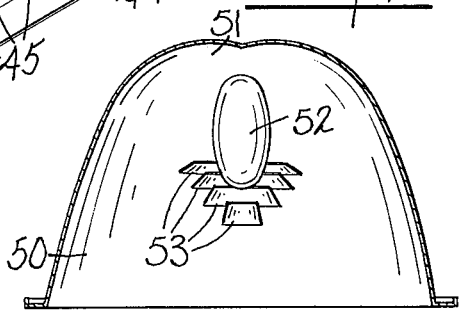
FIG. 7 is a vertical sectional view of another embodiment of the luminaire of the invention.

As an alternative to the pair or pairs of parabolic reflectors shown in FIGS. 2, 4, 5 and 6 the reflector may be a parabolic surface of revolution, as shown at 50 in FIG. 7, this reflector being circular in plan or horizontal section and being modified to include a general reflecting area 51 adjacent its apex comparable to the areas 28, 29, 41 and 42. The light source 52 is located at the focal point of the parabolic reflector and has its long axis disposed vertically. A plurality of light absorbers 53 are mounted adjacent the lower part of the light source in positions to cut off tangential light emanations from the envelope of the source 52 in the manner indicated by FIGS. 4 and 6. The light distribution in this case will show the full bat-wing configuration along any vertical plane through the light source, the entire configuration being in the form of a conical bat-wing, with advantages in illumination as described above.

While the invention has been illustrated and described in what are considered to be the most practical and preferred embodiments, it will be recognized that many variations are possible and come within the scope thereof, the appended claims therefore being entitled to a full range of equivalents.

What is claimed is:

1. In a luminaire, the combination of:

a light source in an envelope;

parabolic reflecting surfaces disposed on at least two opposite sides of said light source so that their focal points substantially coincide, said light source being positioned approximately at said coincident focal points and portions of said reflecting surfaces being so positioned that reflections therefrom cross and provide maximum candlepower in the zones of about 25° to about 45° above nadir; and a plurality of light absorbing surfaces positioned between said reflecting surfaces, close to said envelope and generally radially of said light source so as to cut off substantially all light emanating near tangentially from said envelope which would otherwise have reflected into the zones of about 45° to about 90° above nadir;

whereby veiling reflections are substantially eliminated in the zones about 0° to about 25° above nadir and direct glare is eliminated in the zones above about 45° above nadir.

2. A luminaire as in claim 1 wherein the reflecting surfaces are a first pair of parabolic reflectors and a second pair of parabolic reflectors positioned adjacent said first pair of reflectors so as to surround said light source.

3. A luminaire as in claim 1 wherein the reflecting surfaces are portions of a parabolic surface of revolution.

4. A luminaire as in claim 1 wherein said light source is an elongated lamp and wherein said light absorbing surfaces are elongated planes positioned generally radially of the longitudinal axis of said lamp.

5. A luminaire as in claim 4 further including a plurality of light absorbing planes arranged transversely of said lamp so as to cut off direct emanations therefrom into zones of from about 45° to about 90° above nadir.

6. In a luminaire, the combination of:

a light source in an envelope, a reflecting surface in the form of a parabolic surface of revolution disposed about said light source, said light source being positioned approximately at the focal point of said surface of revolution and portions of said reflecting surface being so positioned that reflections therefrom cross and provide maximum candlepower in the zones of about 25° to about 45° above nadir; and a plurality of light absorbing surfaces positioned between said reflecting surface, close to said envelope and generally radially of said light source so as to cut off substantially all light emanating near tangentially from said envelope which would otherwise have reflected into the zones of about 45° to about 90° above nadir;

whereby veiling reflections are substantially eliminated in the zones about 0° to about 25° above nadir and direct glare is eliminated in the zones above about 45° above nadir.

* * * * *

UNITED STATES PATENT AND TRADEMARK OFFICE

CERTIFICATE OF CORRECTION

PATENT NO. : 4,006,355

DATED : February 1, 1977

INVENTOR(S) : Sylvan R. Shemitz and Benjamin L. Stahlheber

It is certified that error appears in the above-identified patent and that said Letters Patent are hereby corrected as shown below:

Column 2, line 38, "objets" should read --objects--.

Column 3, line 26, "bat-swing" should read --bat-wing--.

Column 5, line 2, "Figs. 2 and 4" should read --Fig. 4--.

Signed and Sealed this

Twelfth Day of April 1977

[SEAL]

*Attest:*

RUTH C. MASON
*Attesting Officer*

C. MARSHALL DANN
*Commissioner of Patents and Trademarks*